US012060877B2

(12) United States Patent
Reddy et al.

(10) Patent No.: US 12,060,877 B2
(45) Date of Patent: Aug. 13, 2024

(54) HYDRAULIC FRACTURING PUMP CONTROL SYSTEM

(71) Applicant: Caterpillar Inc., Peoria, IL (US)

(72) Inventors: Suresh Baddam Reddy, Peoria, IL (US); Alexander C. Crosman, III, Dunlap, IL (US); Lucas J Peterson, Washington, IL (US); Bradley Scott Bailey, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 897 days.

(21) Appl. No.: 17/025,716

(22) Filed: Sep. 18, 2020

(65) Prior Publication Data

US 2022/0090594 A1 Mar. 24, 2022

(51) Int. Cl.
*F04B 49/20* (2006.01)
*F04B 49/08* (2006.01)

(52) U.S. Cl.
CPC ..... *F04B 49/20* (2013.01); *F04B 49/08* (2013.01); *F04B 2201/1202* (2013.01); *F04B 2201/1208* (2013.01); *F04B 2203/0207* (2013.01); *F04B 2205/05* (2013.01); *F04B 2207/01* (2013.01)

(58) Field of Classification Search
CPC ..... F04B 49/20; F04B 2201/1208; F04B 2201/1202; F04B 2203/0207; F04B 2207/01; F04B 2205/05; F04B 49/08
See application file for complete search history.

(56) References Cited

U.S. PATENT DOCUMENTS 4,716,347 A * 12/1987 Fujimoto ..... G05D 19/02 318/432
4,879,502 A * 11/1989 Endo ..... H02P 6/14 318/808
5,252,031 A * 10/1993 Gibbs ..... F04B 49/02 417/18
6,287,086 B1 * 9/2001 Steen ..... F04B 1/2085 91/499
6,460,407 B1 * 10/2002 Kato ..... F02M 55/007 73/114.41
6,494,685 B2 * 12/2002 Carstensen ..... F04B 49/20 417/44.1
6,577,089 B1 * 6/2003 Piedl ..... F04B 49/065 318/434

(Continued)

FOREIGN PATENT DOCUMENTS

CN 208337176 4/2019

*Primary Examiner* — Christopher S Bobish
(74) *Attorney, Agent, or Firm* — Lee & Hayes, PLLC

(57) ABSTRACT

A monitor and control system for a hydraulic fracturing pump is described herein to reduce or eliminate harmful oscillations in fluid discharge pressure caused by the pump load dynamics. The monitor and control system receives various sensor data from the operation of the pump, including the pump crank position, and executes a pump control equation or model based on the pump sensor data, pump load data and/or pump speed data. Pump control equations or models are specific to the design and dynamic operation of the pump, incorporating the number of plungers, pump dynamics, motor lag and motor dynamics, etc. Using the pump control equations or models, the monitor and control system determines control commands for the pump motor to reduce or eliminate the oscillatory discharge pressure at the pump.

20 Claims, 6 Drawing Sheets

(56) References Cited

U.S. PATENT DOCUMENTS

| | | | | |
|---|---|---|---|---|
| 7,186,094 | B2 * | 3/2007 | Edlund | F04B 51/00 417/63 |
| 7,516,793 | B2 | 4/2009 | Dykstra | |
| 7,617,691 | B2 * | 11/2009 | Street | G05D 23/1917 62/298 |
| 7,668,694 | B2 | 2/2010 | Anderson et al. | |
| 8,348,627 | B2 * | 1/2013 | Rampen | F04B 1/06 417/139 |
| 8,734,120 | B2 * | 5/2014 | Giewont | H02P 6/22 417/415 |
| 8,997,904 | B2 | 4/2015 | Cryer et al. | |
| 9,291,133 | B2 * | 3/2016 | Pickell | F04B 1/0448 |
| 9,897,082 | B2 * | 2/2018 | Worden | F04B 27/24 |
| 9,945,365 | B2 | 4/2018 | Hernandez et al. | |
| 10,132,304 | B2 * | 11/2018 | Hase | G05D 16/2066 |
| 10,246,984 | B2 | 4/2019 | Payne et al. | |
| 10,415,348 | B2 | 9/2019 | Zhang et al. | |
| 10,494,911 | B2 * | 12/2019 | Harding | E21B 47/008 |
| 10,608,561 | B2 * | 3/2020 | Sumita | H02P 21/05 |
| 10,781,813 | B2 * | 9/2020 | Assad | G01L 25/00 |
| 11,118,577 | B2 * | 9/2021 | Gerz | F04B 13/00 |
| 11,378,072 | B2 * | 7/2022 | Okubo | F04B 49/022 |
| 11,401,883 | B2 * | 8/2022 | Styron | F02D 41/406 |
| 11,499,544 | B2 * | 11/2022 | Beisel | F04B 49/10 |
| 2007/0065302 | A1 * | 3/2007 | Schmitz | F04B 39/08 417/298 |
| 2007/0132603 | A1 * | 6/2007 | Edlund | F04B 51/00 340/665 |
| 2014/0297062 | A1 * | 10/2014 | Anderson | F02D 41/021 701/1 |
| 2017/0002805 | A1 * | 1/2017 | Williams | F04B 17/03 |
| 2017/0298924 | A1 * | 10/2017 | Chen | F04B 49/08 |
| 2019/0106970 | A1 | 4/2019 | Oehring | |
| 2019/0162061 | A1 | 5/2019 | Stephenson | |

* cited by examiner

HYDRAULIC FRACTURING PUMP CONTROL SYSTEM

TECHNICAL FIELD

This disclosure relates generally to techniques and systems for monitoring and controlling hydraulic fracturing pumps at fracking sites and, more specifically, for detecting and canceling or reducing harmful oscillations in pump speed, torque, fluid discharge pressure, and/or flow.

BACKGROUND

During a hydraulic fracturing process, high-pressure fluid is pumped into a wellbore to create cracks in subterranean rock formations through which oil or gas are extracted. The injection of fracking fluids at high-pressures into the rock creates and holds open fractures, which stimulates the flow of oil and gas through the rock and allows larger volumes of oil and gas to be extracted. Hydraulic fracturing pumps used to inject high-pressure fracking fluids include, among other components, a motor, a crankshaft, a pump, and an operator system through which a human operator controls the speed, flow, or pressure of the fluid injection. In some hydraulic fracturing operations, multiplex pumps are used consisting of a power end and a fluid end. A power end of a multiplex pump houses a crankshaft and a number of connecting rods that connect to pistons or crossheads. A fluid end houses a number of plungers that receive low-pressure fracking fluid and discharge the fracking fluid at high-pressures.

Sensors and diagnostic systems for hydraulic fracturing operations are useful for monitoring the input/output and flow of the pump, and for detecting leaks and other system failures. However, diagnostic systems are generally reactive in nature, and limited in the scope of the problems/failures they are able to detect within hydraulic fracturing pumps. For example, pressure oscillations caused by the normal operation of the pump can be exacerbated by inertia and the motor-pump dynamics, resulting in large fluctuations in torque, discharge pressure, and the fluid speed/flow output by the system. These fluctuations increase the wear and shorten the life of the pump components. Such fluctuations also affect the torque and thermal capabilities of the pump motor which impacts the performance of the overall system.

For example, U.S. Pat. No. 7,668,694 ("the '694 patent") describes a control system for determining and controlling wellbore fluid level, output flow, and desired pump operating speed during operation of a centrifugal pump used in oil production. The system described in the '694 patent includes a vector feedback model to derive values of torque and pump speed, and pump model which derives values of fluid flow rate and head pressure. Controllers are engaged to control the pump to maintain a desired output flow rate from the pump. However, the system described in the '694 patent does not discuss or address potential problems involved in controlling a reciprocating positive displacement pump used in hydraulic fracturing, particularly, of detecting and reducing oscillations in fluid discharge pressure, torque pulsations, and resulting pump/fluid speed/flow. Further, any solution involving pump speed feedback control by itself would have insufficient bandwidth to overcome oscillations, particularly beyond lowest speeds, and in fact could exacerbate such oscillations. Eliminating oscillations in flow help provide smooth flow control as well as improve life of pump, motor and motor drive system components by reduced pulsations.

Example embodiments of the present disclosure are directed toward overcoming the deficiencies described above.

SUMMARY

In order to overcome the problems and deficiencies with hydraulic fracturing processes noted above, the techniques and systems described herein relate monitoring and controlling hydraulic fracturing pumps to detect and reduce oscillations in fluid discharge pressure, torque pulsations, and fluid speed/flow. Monitor and control systems receive various sensor data during the operation of a hydraulic fracturing pump, including crank position data, and execute one or more models or algorithms based on the data to determine pump control commands to cancel or reduce the torque/pressure oscillations at the pump.

In an example of the present disclosure, a motor control system associated with a hydraulic fracturing pump includes a pump crank position sensor, one or more central processing units (CPUs), and memory storing executable instructions that, when executed by the one or more CPUs, cause the CPUs to perform various operations. In this example, the operations include transmitting a first control command to a motor associated with the hydraulic fracturing pump, and receiving crank position data from the pump crank position sensor, the crank position data indicating an orientation of a crankshaft of the hydraulic fracturing pump at a first time during the operation of the motor. The operations further include determining load data associated with the hydraulic fracturing pump as the motor operates in accordance with the first control command, determining an oscillating load pattern associated with the hydraulic fracturing pump, and determining a second control command for the motor associated with the hydraulic fracturing pump, based at least in part on the crank position data, the load data, and the oscillating load pattern associated with the hydraulic fracturing pump. Additionally, in this example the operations include transmitting the second control command to the motor associated with the hydraulic fracturing pump.

In another example of the present disclosure, a method comprises receiving crank position data associated with a hydraulic fracturing pump, the crank position data indicating an orientation of a crankshaft of the hydraulic fracturing pump at a first time during operation of a motor associated with the hydraulic fracturing pump. The method in this example includes determining load data associated with the hydraulic fracturing pump during the operation of the motor, and determining a control command for the motor associated with the hydraulic fracturing pump, based at least in part on the crank position data and the load data. Additionally, in this example, the method further includes controlling the motor associated with the hydraulic fracturing pump based at least in part on the determined control command.

In yet another example of the present disclosure, one or more non-transitory computer-readable media store instructions executable by a processor, wherein the instructions, when executed, cause the processor to perform operations including receiving crank position data associated with a hydraulic fracturing pump, the crank position data indicating an orientation of a crankshaft of the hydraulic fracturing pump at a first time during operation of a motor associated with the hydraulic fracturing pump, and determining load data associated with the hydraulic fracturing pump during the operation of the motor. In this example, the operations further include determining an oscillating load pattern associated with the hydraulic fracturing pump, and determining a control command for the motor associated with the hydraulic fracturing pump, based at least in part on the crank position data, the load data, and the oscillating load pattern associated with the hydraulic fracturing pump. Additionally, in this example, the operations include controlling the motor associated with the hydraulic fracturing pump based at least in part on the determined control command.

DETAILED DESCRIPTION

Figure 1:
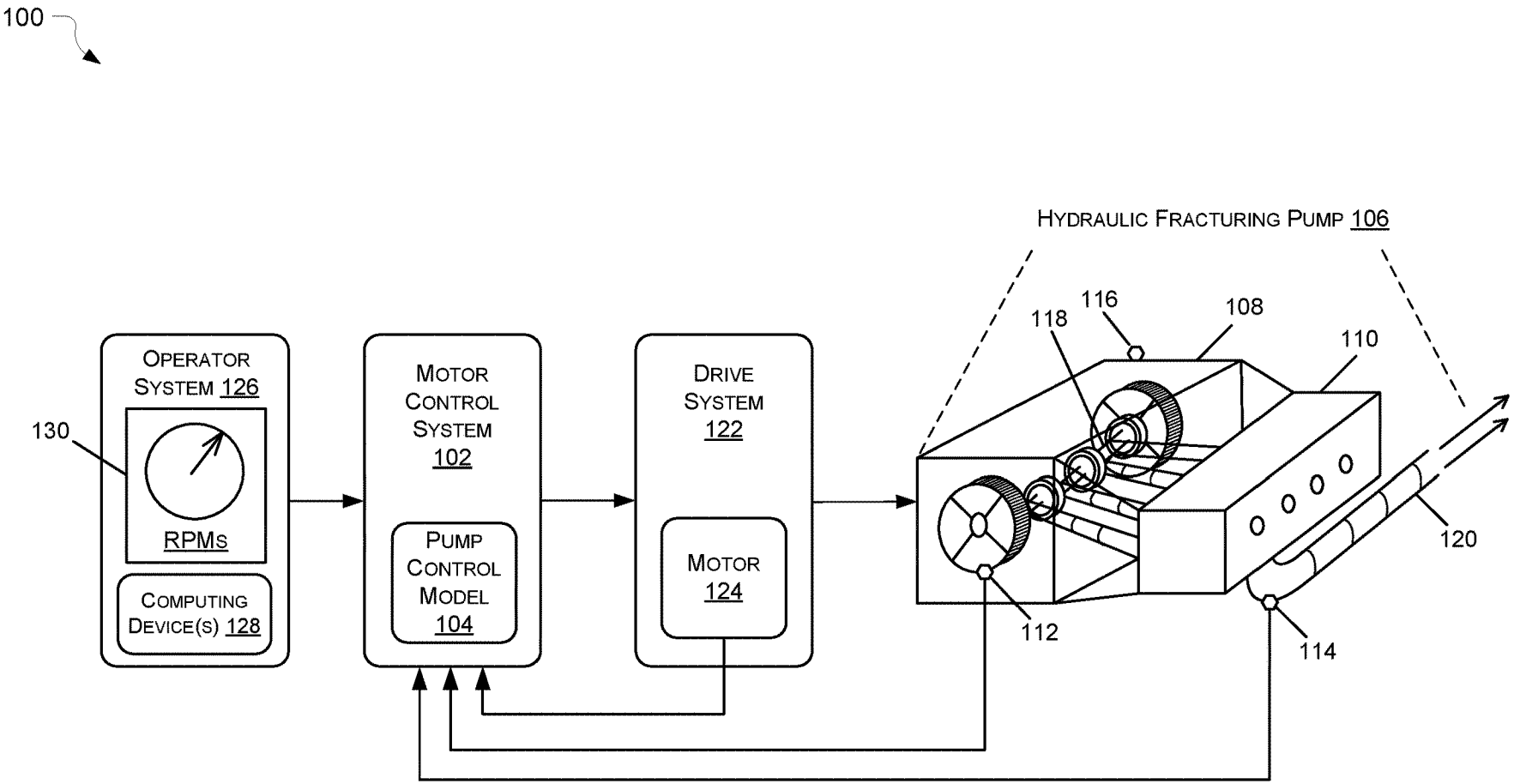
FIG. 1 illustrates an example system including a motor control system configured to monitor and control a hydraulic fracturing pump, in accordance with one or more examples of the present disclosure.

FIG. 1 illustrates an example system 100 including a motor control system 102 configured to execute a pump control model 104 associated with a hydraulic fracturing pump 106. As described below, the techniques and systems of the present disclosure relate to monitoring and controlling the motor and/or other components of the hydraulic fracturing pump 106 to cancel or reduce harmful oscillations in the torque, pump speed, and/or fluid discharge pressure caused by the load dynamics of the pump. In this example, the motor control system 102 receives various sensor data from the hydraulic fracturing pump 106, crank position data, and executes the pump control model 104 based on the sensor data and other pump operation data such as pump speed and pump load data. The pump control model 104 in this example is specific to the physical construction and dynamic operation characteristics of the hydraulic fracturing pump 106, such as number of plungers, pump speed, stroke length, gear ratio, motor lag, and pump-motor dynamics, etc. Using the pump control model 104, the motor control system 102 (which is also referred as a motor control system in some cases) determines control commands for the hydraulic fracturing pump 106, such as pump speed or torque commands to cancel or reduce the oscillatory discharge pressure of the hydraulic fracturing pump 106.

In this example, the hydraulic fracturing pump 106 is a multiplex pump having a power end 108 and a fluid end 110. During the operation of the hydraulic fracturing pump 106, the combined effect of pulsating torque loads and inertia causes exacerbated torque/pressure load oscillations, and corresponding fluid speed/flow fluctuations through the fluid end 110 of the pump. In this example, the motor control system 102 detects and uses the pulsation dynamics between the crank position and the torque pulsation of the hydraulic fracturing pump 106, within an inner processing loop to lessen or cancel the torque pulsation dynamics. Specifically, the motor control system 102 determines and applies an oscillatory force to the pump motor to reduce or cancel or the oscillatory load caused by the pulsation dynamics. As noted above, the resulting reduction of the torque/pressure load oscillations of the hydraulic fracturing pump 106 improves the performance of the pump by providing a smoother and more predictable fluid speed and flow from the pump into the wellbore. Reducing the torque/pressure load oscillations of the hydraulic fracturing pump 106 also reduces wear on the motor and other components of the hydraulic fracturing pump 106, including limiting the torque and thermal utilization of the motor, which increases the reliability and longevity of the motor and the hydraulic fracturing pump 106 as a whole.

The power end 108 of the pump 106 houses a crankshaft 118 and a number of connecting rods that connect to pistons or crossheads, while the fluid end 110 houses a corresponding number of plungers. During the operation of the hydraulic fracturing pump 106, each individual plunger pulls low-pressure fracking fluid from a common intake manifold into a plunger pump during the downstroke of the plunger, and then expels the fracking fluid at high-pressure into a common discharge 120 during the upstroke. In various implementations, the hydraulic fracturing pump 106 includes different physical characteristics and/or pump specifications, including various different maximum power inputs (e.g., 2000-4000 BHP), different numbers of plungers (e.g., 2-10 plungers), different stroke lengths (e.g., 2-10 inches), different maximum pump speed values (e.g., 200-400 RPM), along with various different pump weights, gear ratios, etc.

In this example, the motor control system 102 is connected to a drive system 122 including a motor 124 that drives the hydraulic fracturing pump 106. In some cases, the drive system 122 is an electric drive system. In such cases, the motor 124 of the drive system 122 is an electric motor, driven by a variable frequency drive including an inverter and inverter controls. When an electric drive system 122 is used, the motor control system 102 controls the motor speed and/or average torque of the motor 124, by determining and transmitting control commands. For example, to control the torque level output to the hydraulic fracturing pump 106, motor control system 102 instructs the drive system 122 to apply particular voltages and/or currents to the inverter controller, which sends pulse width modulation (PWM) signals to the inverter to provide a steady output voltage to drive the motor 124. Although this example relates to an electric drive system 122 including an electric motor 124, in other examples, the drive system 122 and the motor 124 involve engine and transmission. In some examples, the drive system 122 is coupled to the hydraulic fracturing pump 106 via driveshaft or coupler, and with a gear on the drive/motor side and/or the pump side, or with no gearing.

As noted above, the power end 108 of the hydraulic fracturing pump 106 includes a rotating crank (also referred to as a crankshaft 118) that drives the plungers, directly or indirectly (e.g., via pistons, crossheads, etc.), to cause the fracking fluid to be pulled into and expelled from the plungers during the downstroke/upstroke of the plunger. As the crank rotates, the different plungers take-in and expel fluid at different times during the rotation cycle. For instance, during each 360-degree rotation of the crank, each of the plungers expels high-pressure fracking fluid once. Accordingly, the frequency of torque pulsations the hydraulic fracturing pump 106 is calculated based on the number of plungers times the current pump speed. By way of example, for a 5-plunger hydraulic fracturing pump 106 running at 80 RPMs, the hydraulic fracturing pump 106 outputs 400 torque pulsations per minute, each torque pulsation corresponding to a separate discharge of high-pressure fluid from the fluid end 110. While these high-pressure fluid discharges are referred to as torque/pressure oscillations (or torque/pressure pulsations) in this example, it should be understood that each high-pressure discharge also corresponds to a temporary increase in the fluid speed and flow expelled from the fluid end 110. Each torque/pressure oscillation thus coincides with a flow or speed oscillation, and these terms are used interchangeably herein.

As shown in FIG. 1, the example system 100 also includes an operator system 126. In some examples, the operator system 126 includes one or more computing devices 128, having user input controls that allow the human operator to control the various functions of the hydraulic fracturing pump 106, such as the speed, average torque, flow, pressure, and/or mixture of the fluid injection. For instance, in this example a speed control 130 is shown on a user interface allowing the operator to set the speed (RPM) at which the hydraulic fracturing pump 106 is to operate. In some examples, the operator system 126 is implemented via separate computing device(s) 128 or systems, and/or using a client-side software application executing on a smartphone, personal computer, or computing device of the human operator. In such examples, the operator system 126 may transmit control commands to the hydraulic fracturing pump 106 and receive operational data (e.g., speeds, average torques/pressures, flow rates, engine temperatures, etc.), via one or more communication networks. In other examples, the operator system 126, motor control system 102, and/or drive system 122 are integrated directly into the hydraulic fracturing pump 106. In such cases, user control panel is installed on a frac pump trailer containing the hydraulic fracturing pump 106, to provide the interface for the operator system 126.

Similarly, in this example the motor control system 102 is depicted as a separate computing system operating independently from the drive system 122, the hydraulic fracturing pump 106, and the operator system 126. In such implementations, the motor control system 102 operates on an independent computing system having dedicated processors, memory, and network components, on which it receives user input data from the operator system 126 (e.g., the desired pump speed, pressure, and/or flow input by the human operator), and receives operational and sensor data from the hydraulic fracturing pump 106 and drive system 122 (e.g., current speed, torque, and pressure settings, crank position data, observed sensor data, etc.). In various other implementations, the motor control system 102 are integrated within the operator system 126, and/or within the hydraulic fracturing pump 106 itself. Accordingly, in some examples, the hydraulic fracturing pump 106 includes computing devices and systems (e.g., processing units, memory, communication systems, etc.) which incorporating the techniques and functionality of the operator system 126 and/or the motor control system 102 as described herein.

In the various designs and configurations described herein, the motor control system 102 may operate partially or entirely transparently with respect to the operator system 126 and/or with respect to the hydraulic fracturing pump 106. For instance, in some examples the motor control system 102 receives a pump speed command, an average torque/pressure command (and/or other pump operational commands) from the operator system 126, uses the pump control model 104 to determine the motor control commands to implement the desired pump speed and average torque in a manner that reduces or eliminates torque oscillations, and then transmits the motor control commands to the drive system 122 for controlling the motor 124.

During the operation of the hydraulic fracturing pump 106, the motor control system 102 receives various data collected by one or more sensors (e.g., 112-116) installed on or otherwise associated with the hydraulic fracturing pump 106. For example, sensor 112 is a crank position sensor that monitors the angular position of the crankshaft 118 within the power end 108, and transmits crank position data and corresponding time data to the motor control system 102. In some cases, the crank position data identifies the current orientation of the crankshaft 118 during its rotation, represented as angle in degrees from 0 to 360 and/or in smaller or larger increments of angular position (e.g., tenths of degrees or hundredths of degrees, etc., or two-degrees increments, five-degree increments, etc.).

As discussed below, in some examples, motor control system 102 determines the pump speed and/or the average torque output from the motor 124 to the hydraulic fracturing pump 106, based on the motor control commands used to control the motor 124. For instance, the motor control system 102 calculates an estimated average torque of the hydraulic fracturing pump 106 based on the voltages and current signals applied to the inverter within an electric motor 124 in some cases. The speed of the motor may be estimated by the electrical frequency of the voltage, or the motor control system 102 also may receive pump speed data as feedback from the motor 124 as it is driving the power end 108 of the pump. Additionally or alternatively, various motor sensors are also used to confirm or calibrate the torque/pressure output of the hydraulic fracturing pump 106 during the operation of the pump. Such sensors detect data from the power end 108 and/or fluid end 110 of the hydraulic fracturing pump 106. For instance, sensor 114 in this example is a pressure sensor that monitors the discharge pressure of the fluid expelled from the fluid end 110 during the operation of the hydraulic fracturing pump 106. In some instances, data from the pressure sensor 114 is used to detect oscillations in the discharge pressure, which also correspond to oscillations in the torque output of the motor 124 and/or oscillations in the speed/flow of the fluid from the fluid end. As noted above, a pressure sensor 114 is optional in some cases and need not be used, in which case the motor control system 102 uses one or more proxies to estimate pump load, such as a load/torque estimate calculated based on the control commands transmitted to the motor 124 along with the specifications of the hydraulic fracturing pump 106 (e.g., gear ratio, number of plungers, stroke length, etc.), from which the motor control system 102 calculates an estimated pump load.

As shown in this example, the motor 124 is configured to measure the current speed (e.g., in RPMs) at which the motor is operating (which corresponds to the pump speed of the hydraulic fracturing pump 106), and transmit the motor speed/pump speed data back to the motor control system 102. In some examples, the motor control system 102 uses data such as crank position data from sensor 112, an estimated average load/torque data based on the currents and voltages applied at the drive system 122 to the motor 124, and the motor speed/pump speed data received from the motor 124 via the feedback loop or estimated from estimated frequency of the voltage signals as the inputs to the models/equations for canceling or reducing torque oscillations. In other cases, the motor control system 102 receives and uses pump speed data collected by a pump speed sensor 116 within the power end 108 of the hydraulic fracturing pump 106.

Although this example depicts the motor control system 102 receiving potentially three types of sensor data from the hydraulic fracturing pump 106 (e.g., crank position data from sensor 112, discharge pressure data from sensor 114, and pump speed data from sensor 116), in other examples the motor control system 102 receives various additional or alternative sensor data from the hydraulic fracturing pump 106 and/or data from other sources. For instance, sensors 114 and 116 are optional in some implementations. Additionally, in some cases the motor control system 102 also receives data from one or more flow iron sensors, motor temperature data, fracking fluid composition or temperature data, and/or data from other hydraulic fracturing pumps 106 at the same site, etc.

The motor control system 102 receives the sensor data (e.g., crank position data) and/or other data associated with the operation of the hydraulic fracturing pump 106 (e.g., pump speed and average load/torque data), and provides this data as input to a pump control model 104. The pump control model 104 executes based on the input data received by the motor control system 102, and outputs data for controlling the motor 124 associated with the hydraulic fracturing pump 106 to reduce or eliminate harmful oscillations in flow. In some examples, the pump control model 104 includes equations and/or other software components that are executed within the motor control system 102, including equations for outputting motor control commands based on an input crank position (and associated time), pump speed data, and estimated average load/torque data. The pump control model 104 includes physics-based equations, using the pump specifications, for calculating data such as the cylinder velocity, fluid discharge velocity, total discharge velocity and volumetric flow, average pressure, total torque, average torque, and the resulting pulsating portion of the total torque, as described in more detail below with example equations.

The pump control model 104, in various implementations, includes one or more algorithms configured to use crank position data collected at one or more times during the operation of the hydraulic fracturing pump 106, along with average pump speed and/or average pump load for the hydraulic fracturing pump 106 at associated times during the operation of the pump. Based on this data, the pump control model 104 outputs one or more recommended commands for controlling the operation of the hydraulic fracturing pump 106. In various examples, the pump control model 104 includes equations based on the torque/pressure oscillations generated by the hydraulic fracturing pump 106 at various pump speeds and average torques. The execution of the pump control model 104 includes identifying a particular phase shift within the torque/pressure oscillations based on pump crank position collected at a particular time. In some cases, the pump control model 104 determines the pressure/load oscillation as a function of the orientation of the crankshaft detected within the power end 108 at a particular time. In such cases, the execution of the pump control model 104 by the motor control system 102 includes determining (or using) the oscillating wave pattern for the discharge pressure/load, along with a phase offset value (or offset crank angle) within the oscillating wave pattern corresponding to the point in time at which the crank position was measured.

In some examples, the pump control model 104 uses limited data inputs, such as the crank position data collected by sensor 112, the estimated average pump load based on the motor control commands (e.g., voltages and currents applied to the motor 124), and/or the motor speed/pump speed data received from the motor 124 via a feedback channel. However, in other examples the pump control model 104 receives and uses additional input data to provide a richer and more robust predictive model for the hydraulic fracturing pump 106. In various examples, the additional inputs to the pump control model 104 include pump load data collected by the sensor 114, pump speed data collected by the sensor 116, various physical characteristics of the hydraulic fracturing pump 106 (e.g., number of plungers, plunger diameter, stroke length, and gear ratio), data relating to the internal pump dynamics (e.g., motor lag, inertial/stiffness dynamics between the power end 108 and fluid end 110), and/or any other sensor data or input received by the motor control system 102 relating to the operation of the hydraulic fracturing pump 106.

In some instances, the output of the pump control model 104 includes a motor control commands such as pump speed and/or torque commands, or series of speed/torque commands that are transmitted by the motor control system 102 to the hydraulic fracturing pump 106 to control the operation of the motor 124. Although referred to as a pump control model 104 in this example, in various implementations the pump control model 104 determines and outputs one or more of pump speed adjustments (e.g., RPMs), torque controls (e.g., N-m), current commands sent to an inverter control, flow amount or intake pressure used to pull low-pressure fluid into the fluid end 110, etc. A motor control commands includes time data in some case that specifies when the command or series of commands is to be transmitted to the motor 124 to cancel or reduces the torque/pressure oscillations. The motor control system 102 executes the pump control model 104 (and/or multiple models, equations, or algorithms) to determine and issue the pump speed adjustments, torque adjustments, current commands, flow amount or intake pressure used to pull low-pressure fluid into the fluid end 110, etc. In various examples, the pump control model 104 outputs any one or a combination of these data, which the motor control system 102 uses to control the operation of the hydraulic fracturing pump 106 in a manner that cancels or reduces the torque/pressure oscillations of the hydraulic fracturing pump 106, thereby providing a more consistent pump operation with a smoother pump speed, torque, and fluid flow.

Figure 2:
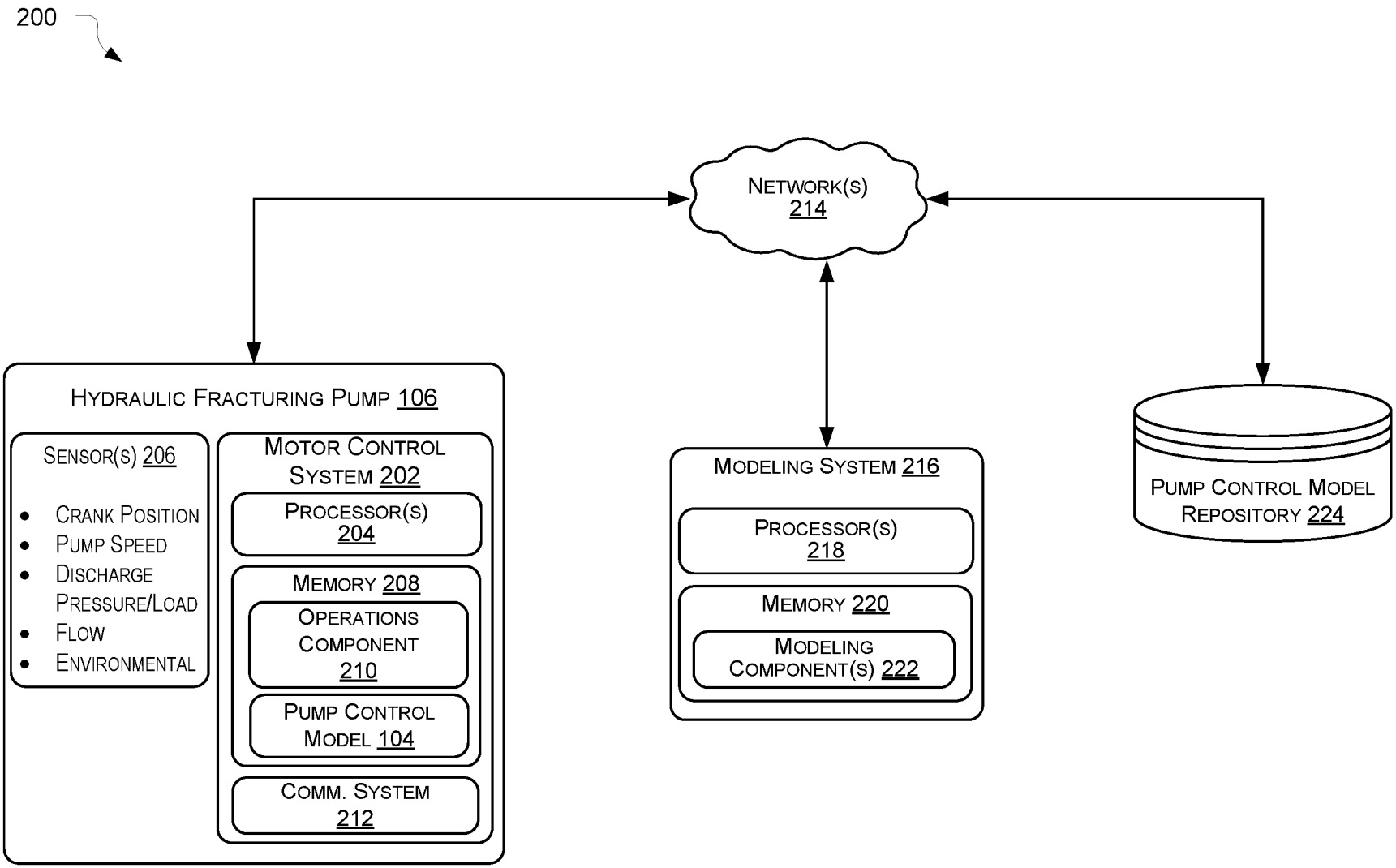
FIG. 2 is a block diagram illustrating an example computing environment including a modeling system for generating a pump control model for a hydraulic fracturing pump, in accordance with one or more examples of the present disclosure.

FIG. 2 depicts a computing environment 200 including various components for generating and executing pump control models 104 based on data from hydraulic fracturing pumps 106. In this example, the computing environment 200 includes a modeling system 216 configured to generate pump control models 104 to be used by the motor control system 102 of hydraulic fracturing pump(s) 106. As discussed below, the pump control models 104 generated by the modeling system 216 include equations for determining motor control commands (e.g., speed and torque commands, command sequences, etc.) to be transmitted to the drive system 122 to control the motor 124. The equations of a pump control model 104 for a hydraulic fracturing pumps 106 receive inputs including the position/orientation of the crankshaft 118, the current pump speed, and the current average pump load/torque, and output the motor control commands and timing that the commands are to be transmitted to the motor 124 to reduce or eliminate the speed oscillations at the hydraulic fracturing pump 106. As described below, the modeling system 216 generates the pump control model 104 for a particular hydraulic fracturing pump 106 based on the design specifications of that pump, such as the number of plungers, plunger diameter, stroke length, gear ratio, and/or internal pump dynamics. Using this data, the pump control models 104 is built and calibrated by the modeling system 216 to detect/predict oscillating patterns in the torque/pressure that will be output by the hydraulic fracturing pump 106 at different pump speeds, average loads/torques, and/or other operating characteristics. Pump control models 104 include associated equations/algorithms that are provided to and executed by the hydraulic fracturing pump 106 to determine the motor control commands for the hydraulic fracturing pump 106 to partially or fully cancel out the oscillations, thereby providing a smoother and more consistent pump speed, torque, and flow.

In FIG. 2, the hydraulic fracturing pump 106 is similar or identical to the corresponding hydraulic fracturing pump 106 described above in FIG. 1, but depicts additional systems and components, including hardware, memory, and network components, to describe in more detail the techniques performed by the hydraulic fracturing pump 106. FIG. 2 also depicts various components of the modeling system 216, and a repository 224 for pump control models generated by the modeling system 216, and the network(s) 214 over which the components in the computing environment 200 communicate.

As discussed above in FIG. 1, the hydraulic fracturing pump 106 includes a motor and fluid end with a number of plungers that receive fracking fluid and then expel the fracking fluid at high-pressure. As illustrated, the hydraulic fracturing pump 106 also includes a motor control system 202 and various sensors 206. The motor control system 202 is implemented via one or more computing device(s) and includes one or more processors 204 and memory 208 communicatively coupled with the processor(s) 204. In some examples, the computing device(s) correspond to an on-board motor control system 202 for the hydraulic fracturing pump 106, which is similar or identical to the motor control system 102 described above. In the illustrated example, the memory 208 of the motor control system 202 stores software-based components to control the on-board operations of the hydraulic fracturing pump 106, including the operations component 210 and the pump control model 104. In some examples, the operations component 210 and/or the pump control model 104 perform some or all of the functionality of the motor control system 102 and/or the operator system 126 described above. In other examples, the motor control system 202 is implemented remotely from the hydraulic fracturing pump 106, in which case the pump control model 104 is also executed remotely from the hydraulic fracturing pump 106. In these examples, the sensor data collected by sensors 206 are transmitted over a network 214 to the remote motor control system 202, which executes the pump control model 104 and transmits the motor control commands to the motor of the hydraulic fracturing pump 106.

The modeling system 216 includes processor(s) 218 and memory 220 communicatively coupled with the processor(s) 218. In the illustrated example, the memory 220 and processors 218 of the modeling system 216 store and execute a modeling component 222, discussed in more detail below. In various implementations, the modeling system 216 is implemented on one or more servers or other computing devices, each of which includes the one or more processors 218 and memory 220 storing computer executable instructions capable of executing the modeling component 222 and/or implementing the various additional functionality of the modeling system 216 described herein. The modeling system 216 also includes network interfaces and components (not shown), and is configured to communicate with one or more hydraulic fracturing pumps 106, the pump control model repository 224, and/or various other external systems or data sources.

In some examples, the modeling system 216 uses modeling software (e.g., modeling component(s) 222) to generate and configure pump control models 104 associated with particular types/models of hydraulic fracturing pump 106, and the resulting pump control models 104 are applicable to hydraulic fracturing pumps 106 of the same type/model which have the same physical characteristics (e.g., number of plungers, plunger diameter, stroke length, gear ratio, etc.) and/or the same internal pump dynamics (e.g., motor lag, inertial/stiffness dynamics between the motor and pump, etc.). After generation by the modeling system 216, the different pump control models 104 are stored in a pump control model repository 224, and are provided to and executed by the motor control system 202 based on the types/model of the hydraulic fracturing pump 106.

In some implementations, the modeling component(s) 222 generates the pump control model 104 entirely based on the design specification and/or physical characteristics of the hydraulic fracturing pump 106. In other implementations, the modeling component(s) 222 also uses data from a particular hydraulic fracturing pump 106 (e.g., a single individual pump in operation, and not from other pumps of the same type/product model) to generate and/or calibrate or configure a pump control model 104 specifically applicable to that particular hydraulic fracturing pump 106. In such instances, the modeling component(s) 222 uses pump-specific data such as pump speed, pressure and flow readings from sensors, pump-specific motor lag data, etc., to generate the pump control model 104 or to calibrate/configure the pump control model 104 for use within the particular hydraulic fracturing pump 106.

Although the systems and components of the hydraulic fracturing pump 106 and the modeling system 216 are illustrated and described as separate components, the functionality of the various systems may be attributed differently than discussed. In various implementations, more or less systems and components are utilized to perform the techniques described herein. Furthermore, although depicted in FIG. 2 as separate systems, in other examples the various components and functionality of the modeling system 216 (e.g., the modeling component 222) is incorporated into the hydraulic fracturing pump 106.

The modeling system 216 in this example generates software-based models to predict the oscillating load patterns behaviors of the hydraulic fracturing pump 106, and in particular the magnitude and phase shift of the load oscillation of the hydraulic fracturing pump 106 operating at the different pump speeds and/or different average load/torque values. The modeling system 216 includes a modeling component 222 that generates, tests, and/or calibrates/configures the equations of the model to determine the oscillating load patterns in a most accurate manner possible, based on the input data received by the modeling component 222. In some examples, the modeling component 222 includes a machine design tool (e.g., CAD-based) configured to perform simulations based on physical specifications (e.g., design, topology, and composition) of the hydraulic fracturing pump 106 at various speed-torque combinations across the operating range of the hydraulic fracturing pump 106. The modeling component 222 also simulates various operation conditions, including operating times, speeds, and torques, as well as various combinations of ambient conditions (e.g., temperature, pressure, humidity, etc.) to determine the estimated/predicted torque oscillations during the operation of the hydraulic fracturing pump 106 under the various conditions. The modeling component 222 includes analysis processes with electromagnetic, thermal, and mechanical components to determine the various multiphysics effects and operational characteristics of the hydraulic fracturing pump 106.

As an example, the modeling component 222 (e.g., CAD software) receives as input for a hydraulic fracturing pump 10, the angles during each 360-degree rotation of the crank at which each of the plungers pulls low-pressure fluid and expels high-pressure fluid. These angles are used, along with pump speed and average torque inputs, and the additional structural and geometric characteristics of the hydraulic fracturing pump 106 to determine/predict the torque pulsations that will occur the operation of the hydraulic fracturing pump 106. In such cases, the resulting pump control model 104 is applicable to other hydraulic fracturing pumps of the same type having the same physical characteristics, and the modeling component 222 generates different pump control models 104 for different types of hydraulic fracturing pumps. In other examples, the hydraulic fracturing pump 106 generates a pump control model 104 specific to one particular hydraulic fracturing pump 106, which considers minor differences between pumps, including defects, wear, the installation and/or operating environment of the hydraulic fracturing pump 106, in which case the modeling component 222 generates different models even for different motors of the same type.

During generation of the model, the modeling system 216 optionally calibrates and/or configures pump control model 104 based on sensor data from one or more hydraulic fracturing pump 106. In contrast to the initial model generation process based on the physical specifications of the hydraulic fracturing pump 106, the calibration of the model in such examples uses actual/observed data from hydraulic fracturing pumps operating in production environments. The actual/observed data includes any combination of sensor data readings, temperature readings, motor control commands, motor operational data, motor feedback data. The modeling component 222 retrieves the actual/observed data from hydraulic fracturing pumps and/or data stores storing such data, to evaluate and calibrate the pump control model 104 prior to transmission to the hydraulic fracturing pump 106. In some examples, the pump control model 104 is initially calibrated using computational fluid dynamic modeling (CFD), and is further refined with testing data when and/or if such testing data is available. In some instances, the electromagnetic and CFD models are refined (or correlated) during a development process for multiple different types of hydraulic fracturing pump 106. In such instances, a pump control model 104 generated for a new design of hydraulic fracturing pump 106 includes built-in design assumptions that are more accurate out of the box over time, and including accurate torque oscillation data.

As noted above the modeling component 222 in this example is a CAD-based software tool configured to generate the model for predicting torque oscillations under various operation conditions of the hydraulic fracturing pump 106. In this example, the pump control models 104 described herein are physics based. In some cases, the pump control model 104 is calibrated by determining average torque/pressure estimates for a hydraulic fracturing pump 106 in operation, to be accounted for with appropriate filtering. Such a filter is either fixed or variable depending on speed of the pump, and the frequency for the filter is below the oscillation frequency. Since the oscillation frequency increases with speed, the filter frequency can be increased accordingly. To collect average torque/pressure estimates, the modeling system 216 uses induction pump sensor data and associated motor control commands specific to the particular hydraulic fracturing pump 106, and thus considers any particular pump differences or defects, wear, the installation and/or operating environment of the hydraulic fracturing pump 106. In other examples, the modeling system 216 calibrates the pump control model 104 using data that need not be specific to the particular pump control model 104 that will receive the pump control model 104, but is specific to the one type of hydraulic fracturing pump 106 (e.g., having the same design specifications).

After generating (and/or calibrating) the pump control model 104, the modeling system 216 provides the pump control model 104 to the hydraulic fracturing pump 106, where it is stored in the on-board memory 208 and executed by the operations component 210 to determine the motor control commands to perform in real-time during the operation of the hydraulic fracturing pump 106, to cancel or reduce the torque/pressure oscillations. As described in more detail below, the operations component 210 executing within the hydraulic fracturing pump 106 executes the equations of the pump control model 104 to determine the motor control commands based on data received from sensors 206 (e.g., crank position data at a first time), along with additional operational data (e.g., pump speed, average torque output) while the hydraulic fracturing pump 106 is running in a production environment. The sensors 206 in this example include one or more a crank position sensors, pump speed sensors, pump load sensors (e.g., measuring fluid discharge pressure), flow speed/volume sensors, and one or more environment sensors. Various additional or alternative sensors 206 are used in other examples, including sensors from the flow iron, motor temperature sensors, fracking fluid composition or temperature sensors, and any other sensors capable of detecting the operations and status of the hydraulic fracturing pumps 106. In some instances, sensors 206 include multiple instances of each of these or other types of sensors. For instance, a hydraulic fracturing pump 106 may have multiple different pressure sensors disposed at various locations in and around the fluid intake manifold, plungers, discharge pipes, and values within the hydraulic fracturing pump 106. As shown in this example, various sensors 206 provide data to the motor control system 202, which uses the sensor data as input to the pump control model 104.

The various components and systems within the computing environment 200 also include communication system(s) that enable communication between the various computing device(s) and systems (e.g., hydraulic fracturing pump 106 and modeling system 216) and/or other local or remote device(s) or servers. For instance, the communication system(s) 212 of the hydraulic fracturing pump 106 facilitate communication with the modeling system 216 via one or more networks 214. In various examples, the communication network(s) 214 enable Wi-Fi-based communication such as via frequencies defined by the IEEE 802.11 standards, short range wireless frequencies such as BLUETOOTH®, other radio transmission, or any suitable wired or wireless communications protocol that enables the respective computing device to interface with the other computing device(s).

The processor(s) 204 of the hydraulic fracturing pump 106, and the processor(s) 218 of the modeling system 216 include any suitable processor capable of executing instructions to process data and perform operations as described herein. By way of example and not limitation, the processor(s) 204 and 218 comprise one or more Central Processing Units (CPUs), Graphics Processing Units (GPUs), or any other device or portion of a device that processes electronic data to transform that electronic data into other electronic data that can be stored in registers and/or memory. In some examples, integrated circuits (e.g., ASICs, etc.), gate arrays (e.g., FPGAs, etc.), and other hardware devices are considered processors in so far as they are configured to implement encoded instructions.

Memory 208 and memory 220 are examples of non-transitory computer-readable media. Memory 208 and memory 220 each store an operating system and/or one or more software applications, instructions, programs, and/or data to implement the methods and techniques described herein, and perform the various functions attributed to those systems. Memory 208 and memory 220 are implemented using any suitable memory technology, such as static random-access memory (SRAM), synchronous dynamic RAM (SDRAM), nonvolatile/flash-type memory, or any other type of memory capable of storing information. The architectures, systems, and individual elements described herein include many other logical, programmatic, and physical components, of which those shown in the accompanying figures are merely examples that are related to the discussion herein.

It should be noted that while FIG. 2 is illustrated as a distributed system, in alternative examples, any or all components of the modeling system 216 are implemented within the hydraulic fracturing pump 106, and/or vice versa. Moreover, although various systems and components are illustrated as being discrete systems, these examples are illustrative and more or fewer discrete systems may perform the various functions described herein.

Figure 3:
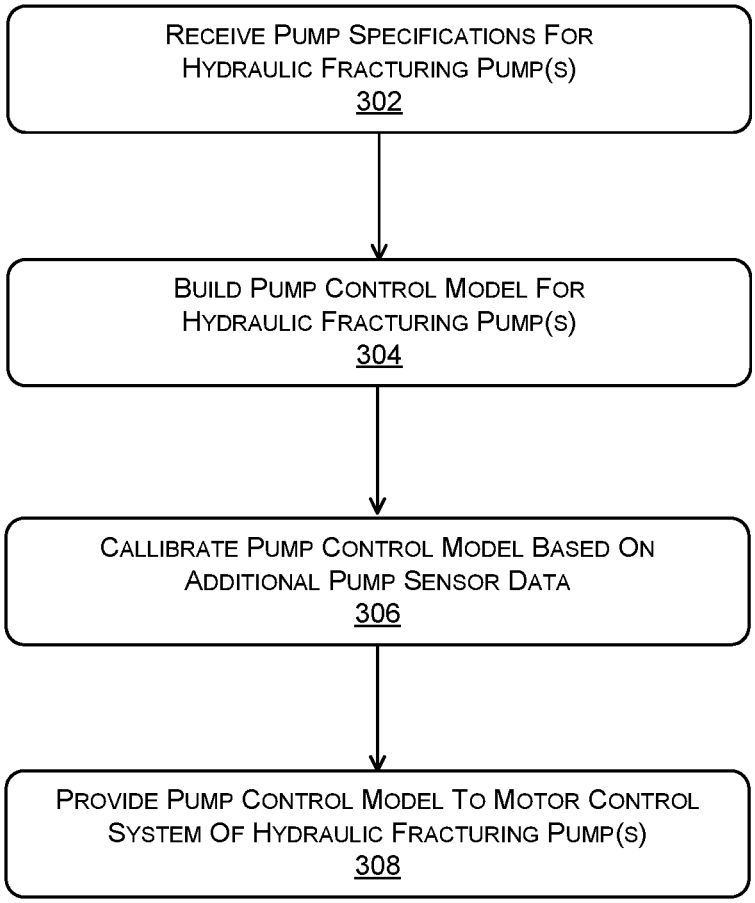
FIG. 3 is a flowchart illustrating an example process of generating a pump control model for a hydraulic fracturing pump, accordance with one or more examples of the present disclosure.

FIG. 3 is a flowchart depicting an example process 300 of generating a pump control model 104 for monitoring and controlling a hydraulic fracturing pump 106. As discussed below, process 300 includes generating (and/or calibrating) a pump control model 104 based on the physical characteristics and design specifications of the hydraulic fracturing pump 106, to detect and reduce the torque/pressure oscillations caused by the pulsating torque loads of the hydraulic fracturing pumps 106 and inertia. In this example, the techniques and operations of process 300 are performed by a modeling system 216 operating within a computing environment 200. However, in various other examples, process 300 is performed by a motor control system 102, operation system 122, and/or a pump motor control system 202, alone or in combination with any of the additional components described above in FIGS. 1 and 2.

At operation 302, the modeling system 216 receives the pump specifications for one or more hydraulic fracturing pumps 106. In some instances, the modeling system 216 includes modeling component(s) 222 with CAD-based software tools configured to predict the torque oscillations of the hydraulic fracturing pumps 106 under various operation conditions. In such instances, the modeling system 216 receives the technical specifications and dimensions of a particular hydraulic fracturing pump 106, and the modeling component 222 analyzes the physical specifications (e.g., component sizes, shapes, material compositions, etc.) for each physical part/component in that hydraulic fracturing pump 106. Such physical specifications include but not limited to gear ratio, number of plungers, stroke length, and plunger diameter, and the angles during each 360-degree rotation of the crank at which each of the plungers pulls low-pressure fluid and expels high-pressure fluid.

In operation 304, the modeling system 216 builds a pump control model 104 including equations for controlling the motor 124 associated with the hydraulic fracturing pump 106 to cancel or reduce the torque oscillations occurring during operation of the hydraulic fracturing pump 106. In some examples, the equations of the pump control model 104 are based on and incorporate the predicted patterns of torque/pressure oscillation associated with the hydraulic fracturing pump 106 when operating at different pump speeds and/or different average torque outputs. In some examples, the modeling component 222 uses finite element analysis (FEA) software tools and/or CAD-based simulation tools to build and execute a model for predicting torque/pressure oscillations and the appropriate motor control commands to cancel or reduce those oscillations under different operating conditions. In various cases, computational fluid dynamic software and/or lumped parameter modeling tools are used, and/or the modeling component 222 also includes processes to analyze the electromagnetic, thermal, and mechanical components of the hydraulic fracturing pump 106, to determine the multi-physics effects and outputs of the motor under various different operating conditions and environments. As noted above, in some examples the modeling component 222 builds a model in operation 304 that is specific to particular hydraulic fracturing pump 106 and/or to multiple different hydraulic fracturing pumps 106 having the same pump type/product model and/or having the same physical characteristics, pump dynamics, etc.

In an example, the modeling component 222 executes a series of geometric-based equations in operation 304, based on the pump specifications received in operation 302, to determine the pulsating torque portion of the overall torque output of the hydraulic fracturing pump 106. In this example, using the average pressure ($P_{avg}$) output by the hydraulic fracturing pump 106, modeling component 222 provides the following algebraic equation in a pump control model 104 for calculating the instantaneous torque per cylinder:

$$\tau_{ai} = p_{avg}\frac{\pi d^2}{4}R\sin(\theta+\phi_i)(1-R/L\cos(\theta+\phi_i)) \quad \text{Equation 1}$$

In this example, $\tau_{ai}$ in Equation 1 represents the instantaneous torque per cylinder output by the hydraulic fracturing pump 106. $P_{avg}$ represents the average pressure output by the hydraulic fracturing pump 106, which the motor control system 202 determines during operation of the pump based on the currents and voltages provided to the motor 124. R represents the crank radius, θ represents the crank angle (e.g., in rad), L represents the rod length, d represents the plunger diameter (e.g., in meters), and $\phi_i$ represents the offset angle for the particular cylinder (e.g., 360*(i−1)/N, where i represents the number of the cylinder and N represents the total number of cylinders in the hydraulic fracturing pump 106).

In this example, Equation 1 is capable of outputting both a positive and a negative $\tau_{ai}$ for a cylinder during the crank cycle. However, in operation the actual torque output ($\tau_i$) for a cylinder i will not be negative. Accordingly, the modeling component 222 in this example uses Equation 2 below to eliminate any negative torque discharge velocities output by Equation 1:

$$\tau_i = \tau_{ai}, \quad \text{if } \tau_{ai} > 0; 0, \text{ if } \tau_{ai} \leq 0 \qquad \text{Equation 2}$$

Continuing with this example, the motor control system 202 computes the total instantaneous torque output from the hydraulic fracturing pump 106 during operation using Equation 3 below:

$$\tau = \sum_{1}^{N} \tau_i \qquad \text{Equation 3}$$

Continuing with this example, $\tau$ represents the total torque output from the hydraulic fracturing pump 106. Additional terms could be added to the equation above, such as inertial torque involved in accelerating the pump crank, or dynamic pressure instead of average, or estimated dynamic in-cylinder pressure rise during initial stroke. As discussed above, a first portion of the total torque output $\tau$ represents the average torque output from the hydraulic fracturing pump 106, and a second portion of the total torque output represents torque pulsations. In this example, the motor control system 202 calculates the average torque output ($\tau_{avg}$) from all cylinders of the hydraulic fracturing pump 106 using Equation 4 below, where C is a constant representing crank-rod kinematics:

$$\tau_{avg} = C * p_{avg} \frac{\pi d^2}{4} R * N \qquad \text{Equation 4}$$

In this example, if the $P_{avg}$ is not available, the average torque is estimated from motor torque estimate from current and voltage signals, and the above relation used to calculate $P_{avg}$, and then, used in Equation 1 to calculate torque. If both torque estimate and pressure are available, an improved calculation of average pressure and torque can be made by synthesis of the two, for example, with use of a Kalman Filter. Continuing this example, the motor control system 202 calculates the pulsating torque portion using Equation 5 below from the pump control model 104, based on the total torque output ($\tau$) from Equation 3 and the average torque output ($\tau_{avg}$) from Equation 4:

$$\tau_{pulsating} = \tau - \tau_{avg} \qquad \text{Equation 5}$$

Additionally or alternatively, the pulsating torque is constructed using techniques that involve developing a harmonic model of the pulsation, and several harmonic coefficients and corresponding phase determined from a simulation model. In such examples, the pulsating torque to be used in the feedforward control is represented as the sum of the harmonics, with each harmonic calculated by the multiple of the harmonic coefficient with the sine of the crank angle, plus phase angle for the harmonic.

In estimating average pressure or torque from measurements, filtering is used in some instances to avoid oscillatory terms related to the pulsations. While a filter can be used from these measurements, the filter can be made variable, depending on the speed of the crank, with the filter frequency being below the fundamental pulsation frequency, which is the number of plungers times the crank speed.

Returning to operation 304, in this example the modeling component 222 also determines and models crank position data at multiple times during the simulated operation of the hydraulic fracturing pump 106. The crank position data is determined based on the physical specifications of the hydraulic fracturing pump 106 received at operation 302, and represents the angle (0 to 360 degrees) at the particular time associated with the measurement. In this example, multiple crank position data measurements are determined at times associated with the other operational data and output data determined by the modeling component 222 during the generation of the pump control model 104 (e.g., pump load/pressure and/or torque data).

When simulating the various output data and operational data for a hydraulic fracturing pump 106 in operation 304, such as pump speed data, torque output data, and corresponding crank position data, the modeling component 222 analyzes the combined data to determine a number of observed behaviors of the hydraulic fracturing pump 106 during the time period. For instance, using the output data and operational data, the modeling component 222 determines a first operating state of the hydraulic fracturing pump 106 (e.g., an initial speed command, average torque/torque command, flow command, etc.), and the torque or pressure oscillations associated with the first operating state. The modeling component 222 also uses a simulation of the hydraulic fracturing pump 106 to determine a new control command issued to (e.g., an updated speed, an updated torque, a flow adjustment, etc.), including a particular time and/or crankshaft angle at which the new control command is to be applied, and the effect that the new control command had on the torque/pressure oscillations of the hydraulic fracturing pump 106. For instance, a pump simulation executed by the modeling component 222 determines that the oscillating wave pattern of torque/pressure for a hydraulic fracturing pump 106 increases in magnitude in response to a particular pump control command (e.g., a speed adjustment) performed at particular crank angle.

As noted above, during the model building process in operation 304, the input data received and analyzed by the modeling component 222 includes a set of inputs, such as the physical characteristics and motor/pump dynamics of the hydraulic fracturing pump 106, the characteristics of the simulated oscillating load patterns of torque/pressure pulsations prior to a pump control command, and the characteristics of the simulated pump control command (e.g., type of command, magnitude, and associated crank angle). In these examples, the model inputs are analyzed by the modeling component 222 in view of the model outputs, which include the effect that the simulated pump control command had on the oscillating torque pattern of the simulated hydraulic fracturing pump 106. When a combination of model inputs and the pump control command characteristics results in canceled or reduced torque/pressure oscillations from the hydraulic fracturing pump 106, the modeling component 222 adjusts the equations of the pump control model 104 to more heavily favor performing a similar pump control command in similar scenarios. In contrast, when the combination of model inputs and the pump control command characteristics results in no effect or a magnification of the simulated torque/pressure oscillations from the hydraulic fracturing pump 106, the modeling component 222 adjusts the equations within the pump control model 104 to disfavor performing a similar pump control command in similar scenarios. In these examples, the magnitude of the adjustments made by the modeling component 222 (e.g., to favor or disfavor performing a command during a scenario) are based on the magnitude of the effect torque/pressure oscillations from the simulated hydraulic fracturing pump 106 (e.g., reducing or increasing the oscillations).

At operation 306, the modeling system 216 optionally receives and uses actual observed data associated with one or more hydraulic fracturing pumps 106 to calibrate the pump control model generated in operation 304. In this example, the modeling component 222 retrieves actual operational data records and/or corresponding sensor data associated previous operations from one or more hydraulic fracturing pumps 106. The calibration data includes historical data observed/capture by the sensors (e.g., sensors 112-116) of one or more of the hydraulic fracturing pumps 106 of the type for which the model was built. The calibration data includes sensor data, operational data, and the like captured for specific scenarios while the hydraulic fracturing pumps 106 were operating in real-world production environments. In contrast to performing software simulations based on the physical specifications of a hydraulic fracturing pumps 106 to create the pump control model 104 in operation 304, the calibration based on actual pump data in operation 306 takes into account minor differences in hydraulic fracturing pumps 106 operating in production environments, including minor factory defects wear, differences in installation and/or environmental differences, and the like.

At operation 308, the modeling system 216 provides the pump control model 104 to the on-board motor control system 202 of the hydraulic fracturing pump 106. For instance, the modeling system 216 transmits the pump control model 104 via the network(s) 214, to the motor control system 202. The motor control system 202 stores the pump control model 104 within the memory 208 for on-board execution of the pump control model 104 equations by the operations component 210 while the hydraulic fracturing pump 106 is running. In some examples, the modeling system 216 builds, calibrates, and transmits different pump control models 104 to different hydraulic fracturing pump 106. In such examples, the differences between pump control models 104 are based on the different physical specifications of the hydraulic fracturing pump 106 and/or the different calibration data or operational environment data determined by the calibration processes used at operation 306.

Figure 4:
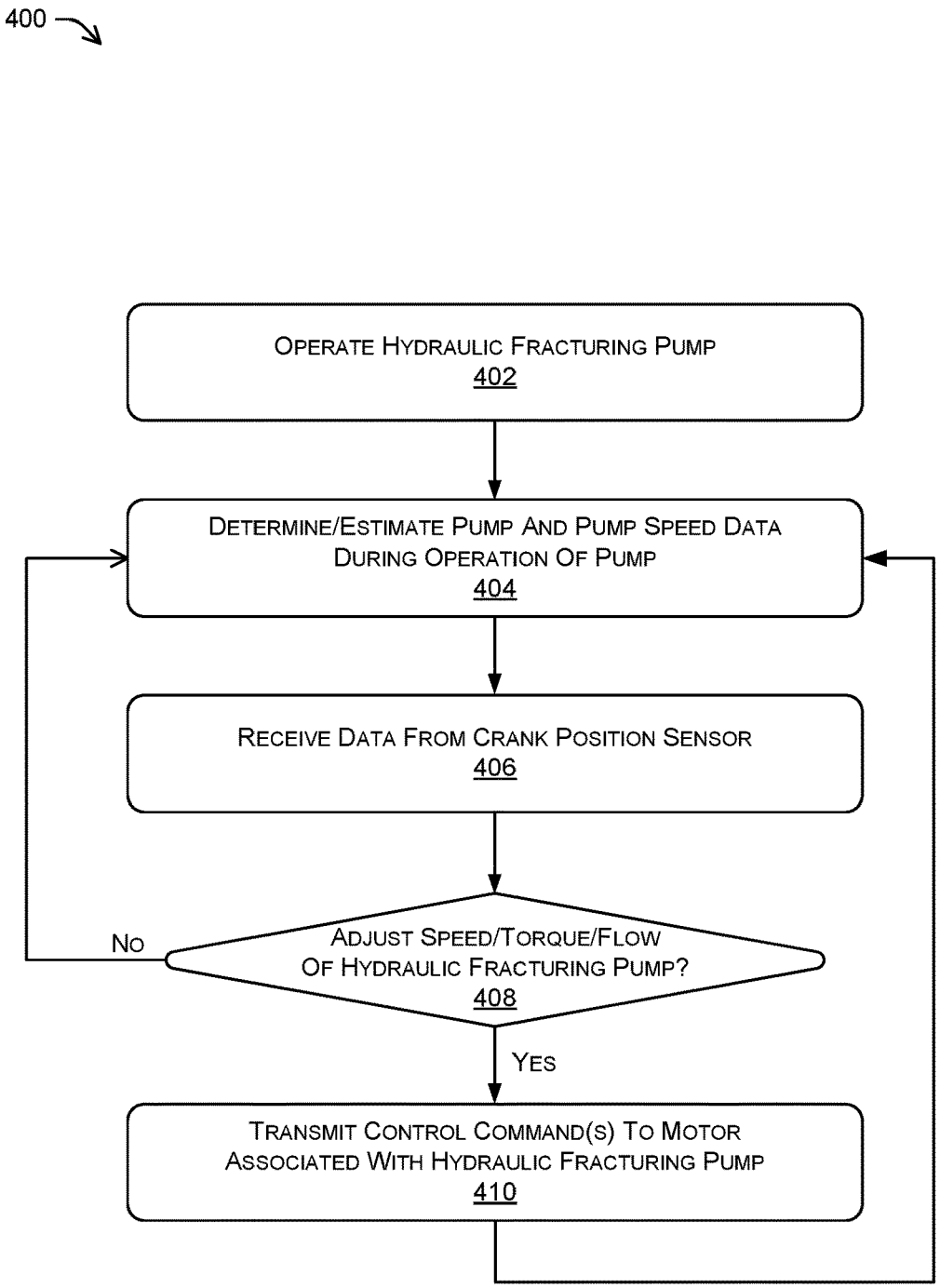
FIG. 4 is a flowchart illustrating an example process of controlling a hydraulic fracturing pump using a pump control model, in accordance with one or more examples of the present disclosure.

FIG. 4 is a flowchart depicting an example process 400 of controlling a hydraulic fracturing pump 106 using a pump control model 104. As discussed below, process 400 describes using a pump control model 104 to control the operation of a hydraulic fracturing pump 106 to cancel or reduce the torque/pressure oscillations based on the operation (e.g., pump speed and average estimated torque) of the pump. In this example, the techniques and operations of process 400 are performed by the motor control system 202 of a hydraulic fracturing pump 106, executing an operations component 210 that uses a pump control model 104 similar or identical to the pump control model(s) 104 described above. However, in various other examples, process 400 is performed by any combination of the additional components described in reference to FIGS. 1-2.

At operation 402, the operations component 210, which may be similar or identical to the motor control system 102 described above, operates a hydraulic fracturing pump 106 in a fracking environment. As discussed above, during the operation of the hydraulic fracturing pump 106, the plungers within the hydraulic fracturing pump 106 pull low-pressure fracking fluid from an intake manifold and expel the high-pressure fracking fluid into the common discharge 120. The specific operation of the hydraulic fracturing pump 106 depends on the pump specifications and physical characteristics, such as the power input of the hydraulic fracturing pump 106, the numbers of plungers, stroke length, gear ratio, pump speed specifications, motor lag, and motor-pump dynamics, etc. Although this example describes the operations component 210 initially controlling the operation of the hydraulic fracturing pump 106, in some examples operation 402 is performed by the operator system 126 and/or by the internal computing device(s) of the hydraulic fracturing pump 106. In such examples, the operations component 210 need not control the initial operation of the hydraulic fracturing pump 106, but monitors the pump operation and sensor data to determine when adjustments are required to the pump operation to cancel or reduce the torque/pressure oscillations of the hydraulic fracturing pump 106.

At operation 404, the operations component 210 determines pump speed data and/or pump load data during the operation of the hydraulic fracturing pump 106. In some examples, the operations component 210 determines the pump speed and pump load at a particular time based on the motor control commands provided by the operations component 210 to the motor 124. As noted above, the operations component 210 or other component within the motor control system 102 controls the motor speed and/or average torque of the hydraulic fracturing pump 106 by determining and applying particular voltages and/or currents to an inverter controller. In operation 404, the operations component 210 retrieves the previous pump speed and torque commands to determine the pump speed data and/or pump load data at the particular time. In some cases, the pump speed and/or pump load data determined at operation 404 are estimates that are based on motor control commands and not any actual observations by sensors.

In other cases, the pump speed and/or pump load data is determined or revised at operation 404 based on actual sensor data collected by one or more sensors 206 of the hydraulic fracturing pump 106. In an example, the estimated pump load data determined based on the motor control commands is biased based on the fluid discharge pressure measurements collected by sensor(s) 114. As discussed above, alternative or additional pump load data are used in other examples, such as speed and/or torque measurement readings collected by sensors 114 and 116 associated with the pump. When pump load sensor data is received in operation 404, such sensor data optionally includes multiple data readings/measurements corresponding to different times during the operation of the hydraulic fracturing pump 106. In some instances, pump load data readings/measurements are collected by pump sensors every second, fraction of second, or every N milliseconds, etc., so that the pump load data received in operation 404 reflects the changes in pump load at the hydraulic fracturing pump 106 over a time period.

At operation 406, the operations component 210 receives crank position data from one or more sensors of the hydraulic fracturing pump 106. The crank position data received in operation 406 includes the angle of the crankshaft 118 within the pump power end 108, as detected by a crank position sensor 112, at one time or a series of different times while the hydraulic fracturing pump 106 is operating. In some examples, the crank position data is collected at the times corresponding to the applicable times for the pump speed and/or pump load data determined in operation 404, so that an estimated pump speed and/or pump load measurement is available for each associated angle value representing the position of the crank position at that time. Accordingly, the operations component 210 may use the combination of estimated pump load/pump speed data determined in operation 404, and crank position data received in operation 406 as input to the pump control model 104 to determine motor control commands to cancel or reduce torque/pressure oscillations.

At operation 408, the operations component 210 determines whether a pump control command is available that, when issued to the hydraulic fracturing pump 106, would be likely to cancel or reduce the current torque/pressure oscillations experienced at the hydraulic fracturing pump 106. To determine whether a pump control command is available, the motor control system 102 executes one or more equations of the pump control model 104 based on the input data received in operations 404 and 406. As described above, in various examples the operations component 210 executes a pump control model 104 selected specifically for the hydraulic fracturing pump 106, and provides as input to the pump control model 104 the pump speed data (e.g., estimated or observed pump speed) and pump load data (e.g., estimated average torque) received at operation 404, and the associated crank position data received at operation 406. The output from the pump control model 104 includes a recommendation of a pump control command or sequence of commands (e.g., pump speed and/or torque adjustment), including the timing of the command(s), that are predicted by the model 104 to cancel or reduce the current torque/pressure oscillations of the hydraulic fracturing pump 106.

In this example, the inputs to the pump control model 104 include at least pump load data (e.g., discharge pressure) and corresponding crank position data at a particular time while the hydraulic fracturing pump 106 is operating. However, as discussed above, in other examples the operations component 210 provides additional or alternative inputs to the pump control model 104, such as the pump speed, the motor-pump dynamics, fluid data, environmental data (e.g., temperature, humidity vibration, etc.) and/or any other combination of the input data described herein.

In some examples, when the output of the pump control model 104 indicates either that the current torque/pressure oscillations of the hydraulic fracturing pump 106 are below a threshold level, and/or that there is no pump control command available that is predicted to cancel or reduce the current torque/pressure oscillations by greater than a threshold amount, then the operations component 210 determines that no control command is to be issued to adjust the operation of the hydraulic fracturing pump 106 (408:No), in which case process 400 returns to operation 404 to determine updated pump operational data and crank position data. Further, in some examples, the pump control model 104 determines one or more pump control commands that are predicted to cancel or reduce the current torque/pressure oscillations of the hydraulic fracturing pump 106, but the commands are outside of a set of predetermined operational parameters that limit the adjustments that the operations component 210 is permitted to make. For instance, in some implementations the operations component 210 is permitted to autonomously issue minor pump control adjustments, but is not permitted to stop the hydraulic fracturing pump 106 or significantly change the pump speed, torque, flow, or fluid composition by greater than threshold amounts. In these examples, process 400 also returns to operation 404 to receive additional pump sensor and operational data, continuing a processing loop during which the pump control model 104 is executed multiple times to monitor and control the torque/pressure oscillations of the hydraulic fracturing pump 106. In contrast, when the output of the pump control model 104 indicates that there is a pump control command available that is predicted to cancel or reduce the current torque/pressure oscillations by greater than a threshold amount, then the operations component 210 determines a control command adjustment to be made to the hydraulic fracturing pump 106 (408:Yes).

At operation 410, the operations component 210 transmits the command(s) determined via execution of the pump control model 104 in operation 408, to control the operation of the hydraulic fracturing pump 106. In various examples, the pump control commands determined by the output of the pump control model 104 include pump speed adjustments (increasing or decreasing), torque adjustments (increasing or decreasing), flow adjustments (increasing or decreasing), or any other commands described herein for controlling he operation of a hydraulic fracturing pump 106. Pump control commands determined in the various examples also include magnitude of the adjustment, and a time at which the pump control command is to be issued in order to have the predicted effect of canceling or reducing the torque/pressure oscillations of the hydraulic fracturing pump 106. In some examples, the motor control system 102 determines the times for issuing/transmitting pump control commands so that the pump control commands are performed when the crankshaft 118 within the pump power end 108 is at a particular position/angle. In such examples, the motor control system 102 takes into account the motor lag, the motor-pump dynamics, and/or any network or data processing delays when determining the times for transmitting control commands to the hydraulic fracturing pump 106.

The pump control commands determined in operation 408 and transmitted in operation 410 need not be single commands to adjust the pump speed, torque, flow, etc. In some cases, the output of the pump control model 104 determines a series of pump control commands that the operations component 210 transmits in sequence to the motor 124 associated with the hydraulic fracturing pump 106 at predetermined times to produce the desired effect of canceling or reducing torque/pressure oscillations. In an example, the operations component 210 determines and transmits pump control commands in operations 408-410 which include a pattern of small increases and decreases to the pump speed, torque, etc., each to be performed at particular times/intervals. In this example, the sequence of small adjustments increasing and decreasing the motor torque, speed, etc., do not impact the overall pump operation in terms of speed, torque, pressure, or flow, but effectively cancel or reduce the torque/pressure oscillations of the hydraulic fracturing pump 106, to provide a more consistent pump operation with a smoother speed, torque, and fluid flow.

In the above examples, the operations component 210 automatically determines and transmits pump control commands in operations 408 and 410, to adjust the operation of the hydraulic fracturing pump 106 in a way that is partially or entirely transparent with respect to the human operator of the hydraulic fracturing pump 106. However, in other examples, the transmission of pump control commands in operation 410 includes notifying and/or receiving permission from a human user operating the hydraulic fracturing pump 106 and/or a manual or automated pump control system within an operator system 126 of a user device or a motor control system 202 integrated into the hydraulic fracturing pump 106. In such cases, the operations component 210 transmits a request and/or recommended pump adjustment to a manual or automated pump control system, receives a response, and then transmits the pump control commands to the hydraulic fracturing pump 106 in response to receiving the approval for the recommended pump adjustment from the manual or automated system.

Figure 5:
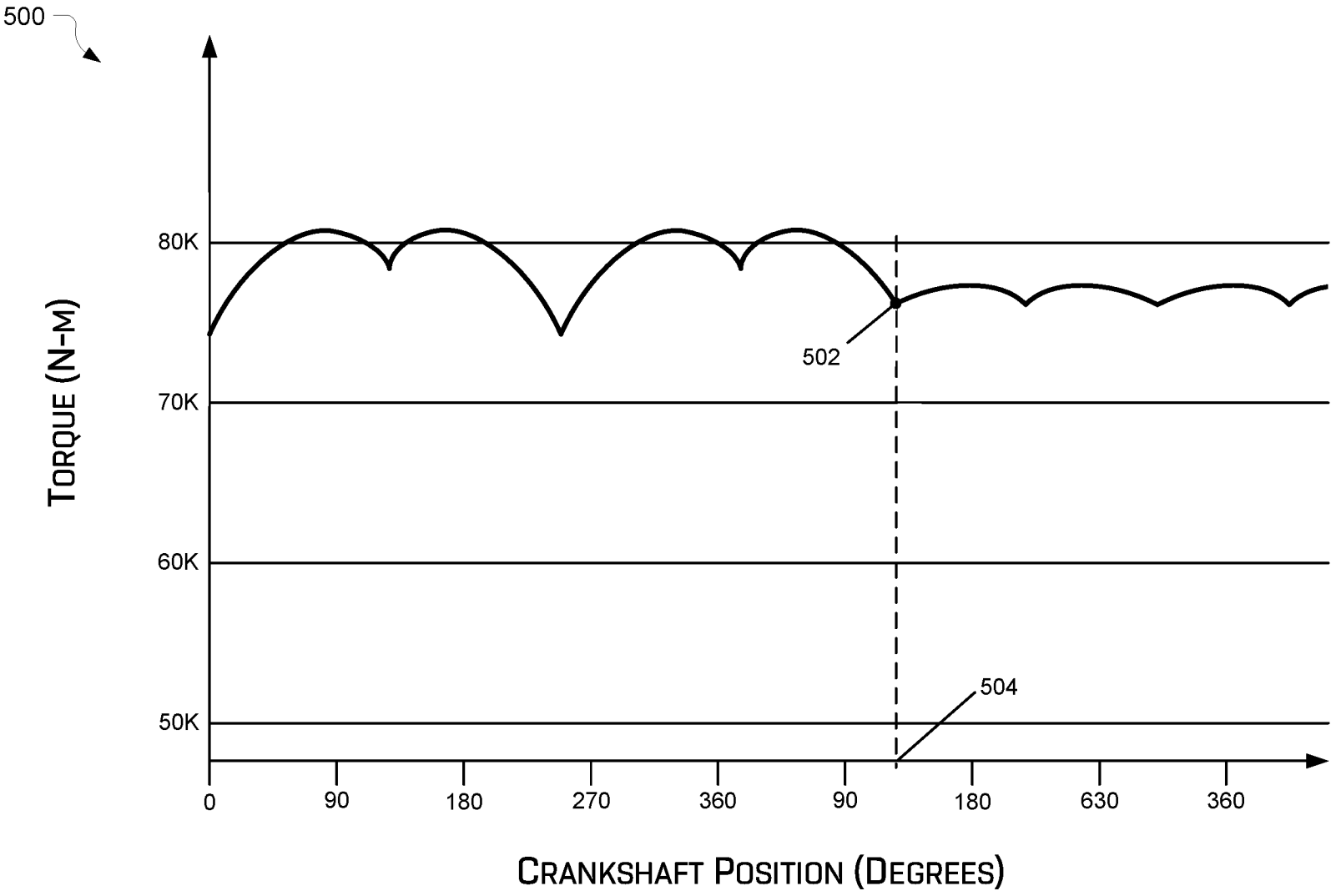
FIG. 5 is an example chart showing torque pulsations in relation to the crank position of the hydraulic fracturing pump, in accordance with one or more examples of the present disclosure.

Referring now to FIG. 5, an example chart 500 is depicted showing a waveform with a series of torque pulsations during the operation of a hydraulic fracturing pump 106 in relation to the angular position of the crank within the power end 108 of the hydraulic fracturing pump 106. In some instances, the torque pulsation data shown in chart 500 is determined by the modeling component 222 during a software-based simulation of a hydraulic fracturing pump 106. In this example, the torque pulsations shown in chart 500 are determined based on a structural analysis of the hydraulic fracturing pump 106 including computational fluid dynamic software. The pulsations (or oscillations) shown in FIG. 5 result from a combination of the individual torque pulsations produced by the different plungers within the cylinders of the simulated pump. As discussed above, the pulsation frequency and pattern are based on the design specifications of the simulated pump, including the number of cylinders and plungers (e.g., 3-plunger, 5-plunger, etc.), the plunger diameter, the crank radius, the rod length, and the motor speed and torque output of the simulated of the pump. In other examples, chart 500 corresponds to actual observed measurements of a hydraulic fracturing pump 106 operating in an environment, rather than from a simulation performed by the modeling system 216. In this example, within the example torque pulsation chart 500 of FIG. 5, the point 502 represents the application of a pump control command during a simulation to adjust the operation of the simulated hydraulic fracturing pump. Various simulated pump control commands consistent with this example include adjustments that increase or decrease the pump speed, torque, flow, or any other adjustments to the operational controls of the hydraulic fracturing pump 106. As shown in this example, the simulated pump control command represented at point 502 is applied at crank angle 504, and had a measurable effect on canceling and reducing the torque pulsations within the hydraulic fracturing pump simulation.

Figure 6:
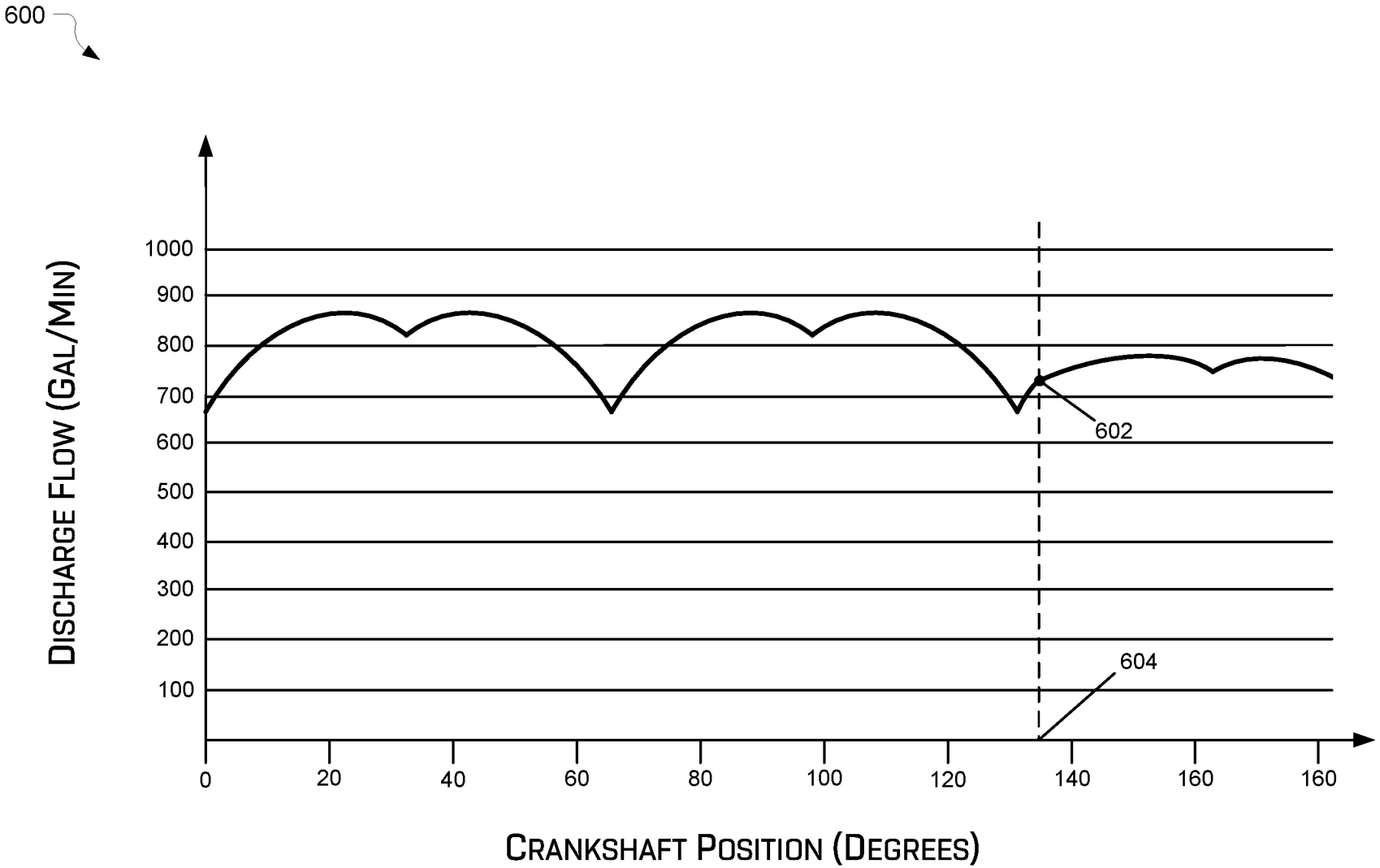
FIG. 6 is an example chart showing discharge flow in relation to the crank position of the hydraulic fracturing pump, in accordance with one or more examples of the present disclosure.

FIG. 6 illustrates another example chart 600 showing a waveform with a set of pulsations of a hydraulic fracturing pump 106. In this example, chart 600 depicts the discharge flow from a simulated hydraulic fracturing pump 106 in relation to the angular position of the crankshaft of the simulated pump. As shown in this example, point 602 represents another simulated pump control, such as a command to increase or decrease pump speed, torque, flow, etc. As shown in FIG. 6, the simulated pump control command 602 was transmitted to the motor of the simulated pump at crank angle 604, resulting in a reduction in the discharge flow pulsations of the simulated hydraulic fracturing pump 106. As these examples illustrate, via the feedforward torque control techniques described herein, the motor control commands applied at the specific times/crank angles determined via analysis of the simulations shown in FIGS. 5-6, cancel and/or reduce both the torque oscillations and reduce flow pulsations within actual hydraulic fracturing pumps 106 operating in production environments.

INDUSTRIAL APPLICABILITY

The present disclosure relates generally to monitoring and controlling the operation of hydraulic fracturing pumps in manner that cancels or reduces harmful pulsations in pump speed, fluid discharge pressure, and flow. In conventional pumps, the normal pressure oscillations resulting from the operation of the pump and motor-pump dynamics, exacerbated by inertia, often result in large fluctuations in torque, discharge pressure, and the fluid speed/flow output by the pump. Such fluctuations increase the wear and shorten the life of the components within the pumps, and also affect the torque and thermal capabilities of the pump motor which impacts the performance of the pump.

Using the systems and techniques described herein, the torque/pressure oscillations of hydraulic fracturing pumps are monitored, and canceled or reduced using a robust predictive model rather than reactive techniques that respond only after the harmful torque/pressure oscillations have occurred. Thus, the techniques described herein for monitoring and controlling the torque/pressure oscillations reduce the wear and lengthen the life of the pump components. These techniques also improve the performance of the pump, by reducing or eliminating oscillations in torque, pressure, and/or flow to provide smoother and more consistent fluid discharge speeds and flows of the fracking fluid from the pump.

Additionally, while certain examples described herein relate specifically to improvements in the operation of hydraulic fracturing pumps, the techniques described herein provide utility for other pump types and/or in other environments where the normal pump operation and/or fluid dynamics result in undesirable oscillations in pump speed, pressure, torque or flow. For instance, the various techniques described herein are applicable to commercial fluid pump systems for wastewater treatment, industrial pumps for transferring fuel or chemicals, irrigation water pumps, or the like.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A motor control system associated with a hydraulic fracturing pump configured to expel high-pressure fracking fluid in a hydraulic fracturing process, comprising:

a pump crank position sensor;

one or more central processing units (CPUs); and memory storing executable instructions that, when executed by the one or more CPUs, cause the CPUs to perform operations comprising:

transmitting a first control command to a motor associated with the hydraulic fracturing pump;

receiving crank position data from the pump crank position sensor, the crank position data indicating an orientation of a crankshaft of the hydraulic fracturing pump at a first time during the operation of the hydraulic fracturing pump;

receiving fluid discharge pressure data associated with the hydraulic fracturing pump as the motor operates in accordance with the first control command;

detecting, based on the fluid discharge pressure data, an oscillating pattern in the fluid discharge pressure of the hydraulic fracturing pump, wherein determining the oscillating pattern comprises:

determining an instantaneous torque per cylinder based at least in part on the fluid discharge pressure data; and determining a torque output of the hydraulic fracturing pump, based at least in part on the instantaneous torque per cylinder;

determining an oscillatory force to apply to the motor of the hydraulic fracturing pump, based at least in part on the crank position data and the oscillating pattern in the fluid discharge pressure;

determining a second control command for the motor associated with the hydraulic fracturing pump, based at least in part on the oscillatory force and the crank position data; and transmitting the second control command to the motor associated with the hydraulic fracturing pump.

2. The motor control system of claim 1, wherein determining the second control command comprises:

receiving a model associated with the hydraulic fracturing pump; and executing an equation associated with the model, wherein executing the equation includes providing the crank position data and the fluid discharge pressure data as input to the equation.

3. The motor control system of claim 2, wherein receiving the model associated with the hydraulic fracturing pump comprises retrieving the model from a plurality of models associated with one or more hydraulic fracturing pumps, based on least in part on:

a number of pistons of the hydraulic fracturing pump;

a plunger diameter associated with the pistons of the hydraulic fracturing pump; and a stroke length associated with the hydraulic fracturing pump.

4. The motor control system of claim 1, wherein determining the fluid discharge pressure data comprises:

receiving fluid discharge pressure measurement data from a sensor associated with the hydraulic fracturing pump during operation of the motor;

applying a filter to fluid discharge pressure measurement data; and determining a frequency for the filter, based at least in part on a speed of the motor and a number of plungers of the hydraulic fracturing pump.

5. The motor control system of claim 1, the operations further comprising:

determining an inertial torque value associated an acceleration of the crankshaft, wherein determining the second control command is further based on the inertial torque value.

6. The motor control system of claim 1, wherein determining the second control command further comprises:

determining a first harmonic based at least in part on a first harmonic coefficient and the crank position data;

determining a second harmonic based at least in part on a second harmonic coefficient and the crank position data; and calculating a sum of the first harmonic and the second harmonic, wherein the second control command is further based on the sum of the first harmonic and the second harmonic.

7. A method, comprising:

receiving crank position data during the operation of a hydraulic fracturing pump configured to expel high-pressure fracking fluid in a hydraulic fracturing process, the crank position data indicating an orientation of a crankshaft of the hydraulic fracturing pump at a first time during operation of a motor associated with the hydraulic fracturing pump;

receiving fluid discharge pressure data associated with the hydraulic fracturing pump during the operation of the motor;

detecting, based on the fluid discharge pressure data, an oscillating pattern in the fluid discharge pressure of the hydraulic fracturing pump, wherein determining the oscillating pattern comprises:

determining an instantaneous torque per cylinder based at least in part on the fluid discharge pressure data; and determining a torque output of the hydraulic fracturing pump, based at least in part on the instantaneous torque per cylinder;

determining an oscillatory force to apply to the motor of the hydraulic fracturing pump, based at least in part on the crank position data and the oscillating pattern in the fluid discharge pressure;

determining a control command based at least in part on the oscillatory force; and controlling the motor associated with the hydraulic fracturing pump based at least in part on the determined control command.

8. The method of claim 7, further comprising:

determining a speed of the motor during the operation of the motor, wherein determining the control command is further based on the speed of the motor.

9. The method of claim 7, wherein determining the control command comprises:

receiving a model associated with the hydraulic fracturing pump; and executing an equation associated with the model, wherein executing the equation includes providing the crank position data and the fluid discharge pressure data as input to the equation.

10. The method of claim 9, wherein receiving the model associated with the hydraulic fracturing pump comprises retrieving the model from a plurality of models associated with one or more hydraulic fracturing pumps, based on least in part on:

a number of pistons of the hydraulic fracturing pump;

a plunger diameter associated with the pistons of the hydraulic fracturing pump; and a stroke length associated with the hydraulic fracturing pump.

11. The method of claim 7, wherein receiving the fluid discharge pressure data comprises:

receiving fluid discharge pressure measurement data from a sensor associated with the hydraulic fracturing pump during operation of the motor;

applying a filter to fluid discharge pressure measurement data; and determining a frequency for the filter, based at least in part on a speed of the motor and a number of plungers of the hydraulic fracturing pump.

12. The method of claim 7, wherein controlling the motor comprises determining a time to transmit the control command to the motor, wherein the time is based on the oscillating pattern in the fluid discharge pressure associated with the hydraulic fracturing pump.

13. One or more non-transitory computer-readable media storing instructions executable by a processor, wherein the instructions, when executed, cause the processor to perform operations comprising:

receiving crank position data during the operation of a hydraulic fracturing pump configured to expel high-pressure fracking fluid in a hydraulic fracturing process, the crank position data indicating an orientation of a crankshaft of the hydraulic fracturing pump at a first time during operation of a motor associated with the hydraulic fracturing pump;

receiving fluid discharge pressure data associated with the hydraulic fracturing pump during the operation of the motor;

detecting, based on the fluid discharge pressure data, an oscillating pattern in the fluid discharge pressure of the hydraulic fracturing pump, wherein determining the oscillating pattern comprises:

determining an instantaneous torque per cylinder based at least in part on the fluid discharge pressure data; and determining a torque output of the hydraulic fracturing pump, based at least in part on the instantaneous torque per cylinder;

determining an oscillatory force to apply to the motor of the hydraulic fracturing pump, based at least in part on the crank position data and the oscillating pattern in the fluid discharge pressure;

determining a control command for the motor associated with the hydraulic fracturing pump, based at least in part on the oscillatory force; and controlling the motor associated with the hydraulic fracturing pump based at least in part on the determined control command.

14. The one or more non-transitory computer-readable media of claim 13, the operations further comprising:

determining a speed of the motor during the operation of the motor, wherein determining the control command is further based on the speed of the motor.

15. The one or more non-transitory computer-readable media of claim 13, wherein determining the control command comprises:

determining a second time at which the control command is to be applied to the motor;

determining a phase offset within the oscillating pattern in the fluid discharge pressure, associated with the second time; and determining the control command for the motor based at least in part on the phase offset associated with the second time.

16. The method of claim 7, further comprising:

determining a number of plungers on the hydraulic fracturing pump, wherein each plunger is configured to receive low-pressure fracking fluid and discharge the fracking fluid at a higher pressure, wherein determining the oscillatory force to apply is further based at least in part on the determined number of plungers on the hydraulic fracturing pump.

17. The method of claim 7, wherein determining the oscillating force comprises:

determining an ambient condition associated with a current operating environment of the hydraulic fracturing pump; and executing an equation associated with a pump control model, wherein a first input to the equation is the crank position data, and a second input to the equation is based on the ambient condition.

18. The method of claim 7, wherein determining the oscillating pattern further comprises:

determining a harmonic model of torque pulsation, based at least in part on a structural feature of the hydraulic fracturing pump.

19. The motor control system of claim 1, wherein determining the oscillating force comprises:

determining an ambient condition associated with a current operating environment of the hydraulic fracturing pump; and executing an equation associated with a pump control model, wherein a first input to the equation is the crank position data, and a second input to the equation is based on the ambient condition.

20. The motor control system of claim 1, wherein determining the oscillating pattern further comprises:

determining a harmonic model of torque pulsation, based at least in part on a structural feature of the hydraulic fracturing pump.

* * * * *